US008573893B2

(12) United States Patent
Siepi et al.

(10) Patent No.: US 8,573,893 B2
(45) Date of Patent: Nov. 5, 2013

(54) INJECTION HEAD FOR CARRYING OUT JET GROUTING PROCESSES

(75) Inventors: Maurizio Siepi, Cesena (IT); Alessandro Ditillo, Cesenatico (IT)

(73) Assignee: SOILMEC S.p.A., Cesena, Forli-Cesena (IT)

( * ) Notice: Subject to any disclaimer, the term of this patent is extended or adjusted under 35 U.S.C. 154(b) by 284 days.

(21) Appl. No.: 12/990,625

(22) PCT Filed: Dec. 29, 2008

(86) PCT No.: PCT/IB2008/055552

§ 371 (c)(1), (2), (4) Date: Nov. 1, 2010

(87) PCT Pub. No.: WO2009/136237

PCT Pub. Date: Nov. 12, 2009

(65) Prior Publication Data

US 2011/0044769 A1 Feb. 24, 2011

(30) Foreign Application Priority Data

May 6, 2008 (IT) ..... TO2008A0335

(51) Int. Cl.
*E02D 3/02* (2006.01)

(52) U.S. Cl.
USPC ..... 405/267; 405/266; 405/269

(58) Field of Classification Search
USPC ..... 405/269, 266, 267
See application file for complete search history.

(56) References Cited

U.S. PATENT DOCUMENTS

| | | | | |
|---|---|---|---|---|
| 4,449,856 | A * | 5/1984 | Tokoro et al. | 405/269 |
| 4,859,119 | A * | 8/1989 | Chida et al. | 405/269 |
| 5,228,809 | A | 7/1993 | Yoshida et al. | |
| 5,343,968 | A * | 9/1994 | Glowka | 175/231 |
| 7,000,714 | B2 | 2/2006 | Gessay et al. | |

FOREIGN PATENT DOCUMENTS

| | | | |
|---|---|---|---|
| EP | 1 396 585 | A1 | 3/2004 |
| JP | 10-195862 | A | 7/1998 |
| JP | 2003-096762 | A | 4/2003 |
| JP | 2004-353298 | A | 12/2004 |
| JP | 2007-016534 | A | 1/2007 |
| SU | 1084367 | A | 4/1984 |

* cited by examiner

*Primary Examiner* — Frederick L Lagman
*Assistant Examiner* — Carib Oquendo
(74) *Attorney, Agent, or Firm* — Merchant & Gould P.C.

(57) ABSTRACT

An injection head includes an upper inlet pipe (12) for receiving fluid from a set of tubular rods which can be mounted above the head, at least a first pipe (13) having a curved intermediate portion (14) which connects the upper inlet pipe (12) to at least one lateral injection nozzle (11), at least a second pipe (15) for conveying a fluid from the inlet pipe (12) to a lower outlet pipe (17) which can be connected to a drilling tool. The injection head also has valve (20-23) which can be actuated to cut off the flow of the fluid towards the lower outlet pipe (17). The valve is located in a position downstream of the upper inlet pipe (12) and above, or upstream of, the lateral nozzles (11) and the second pipes (15).

4 Claims, 1 Drawing Sheet

FIG.1
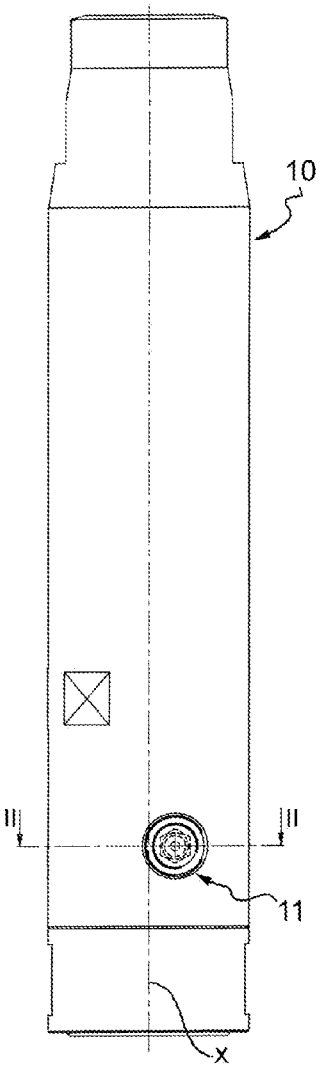
FIG.4
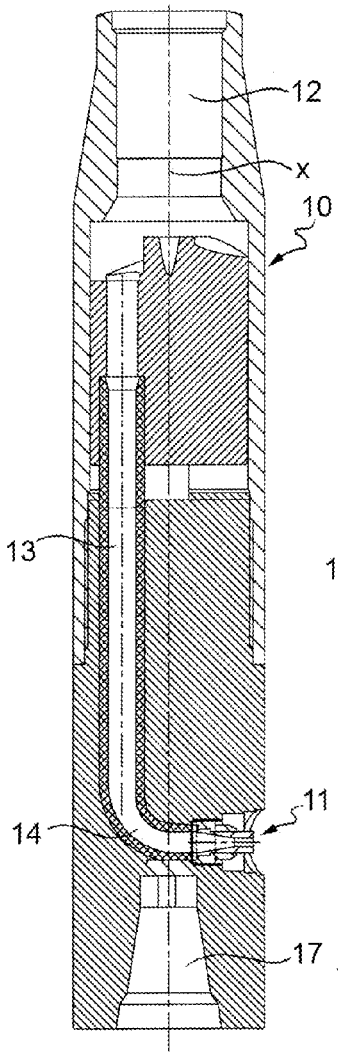
FIG.5
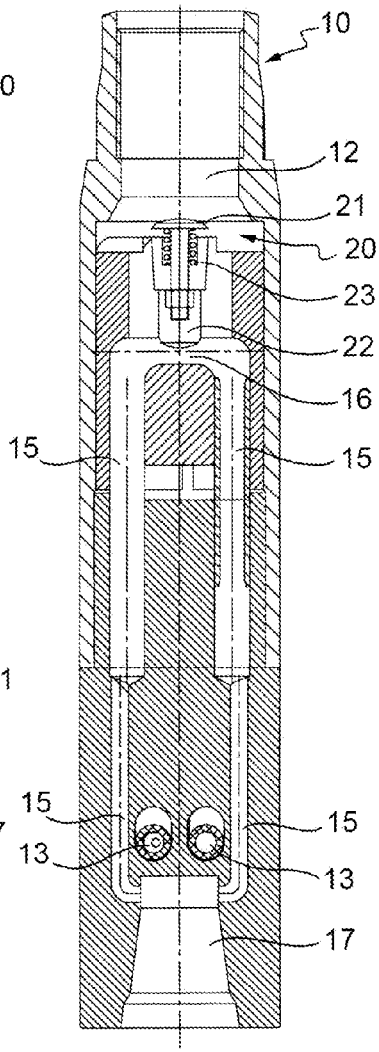
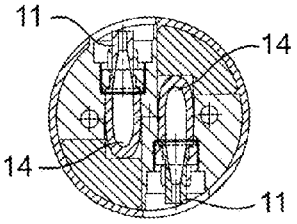
FIG.2
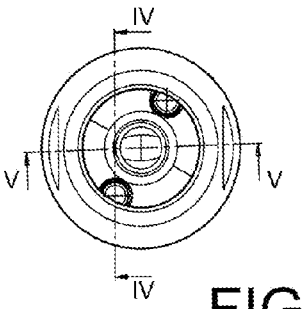
FIG.3

INJECTION HEAD FOR CARRYING OUT JET GROUTING PROCESSES

This application is a National Stage Application of PCT/IB2008/055552, filed 29 Dec. 2008, which claims benefit of Serial No. TO2008A000335, filed 6 May 2008 in Italy and which applications are incorporated herein by reference. To the extent appropriate, a claim of priority is made to each of the above disclosed applications.

FIELD OF THE INVENTION

The present invention relates to a head for injecting pressurized fluid consolidating mixtures into soil in order to form consolidated areas of soil.

BACKGROUND OF THE INVENTION

The methods known as "jet grouting" are used to form columnar artificial conglomerate structures in the soil. These methods are based on the mixing of particles of the soil itself with binders, usually cement mixtures, which are injected at high pressure through small radial nozzles formed in an injection head (commonly referred to as a "monitor" in this technical field) fixed in the proximity of the lower end of a set of tubular rods which is rotated and withdrawn towards the surface. The jets of binder are dispersed and are mixed with the surrounding soil, thus creating a conglomerate body, generally of cylindrical shape, which, when hardened, forms a consolidated area of soil. The dispersing efficacy of the jet can be increased by the addition of injected water and/or pressurized air.

At the bottom of the set of tubular rods, under the monitor, there is fixed a drilling tool which is lubricated, during the excavation phase, with a drilling fluid supplied through the rod.

In the methods used up to the present time, both the consolidating mixture and the drilling fluid are supplied, in successive phases, through the same pipe inside the rod. When the desired depth is reached, the supply of the drilling fluid is halted and the injection of the consolidating mixture commences. The flow towards the drilling tool is blocked by a ball valve or an automatic valve, thus diverting the whole flow of the consolidating mixture towards the lateral nozzles.

Progress has recently been made in the limiting of the pressure losses which occur inside the monitor. These pressure losses are due to turbulence caused by the abrupt change of direction (from vertical to horizontal) inside the monitor, and reduce the efficiency of the system.

In a recently proposed system, the consolidating mixture is diverted from the vertical pipe to the lateral nozzles through one or more curved pipes which convey the fluid streams along a path having a gradual change of direction, thus reducing turbulence. In U.S. Pat. No. 5,228,809, use is made of a pipe of constant cross section and regular curvature. In EP 1 396 585, use is made of pipes of variable curvature which are progressively tapered.

In these cases also, the drilling process requires a supply of drilling fluid to the tool or bit during the initial drilling phase, while the injection of the consolidating mixture takes place subsequently during raising. Since the known systems for producing high-efficiency jet tools (known as "high-efficiency injection heads") are characterized by the continuity of the pipe from the rod to the nozzle, it is necessary to provide another channel to be used solely for the flow of the drilling fluid in order to lubricate the drilling tool. Consequently, there will be a drilling set with two passages in the case of a single-fluid system, a set with three passages in the case of a double-fluid system, and so on. The alternative approach is to form a preliminary hole into which the jet grouting set with a monitor can be inserted subsequently, without the possibility of lubricating a drilling tool. See, for example, JP 10 195862.

In many conventional monitors, the cement mixture required for the jet treatment tends to block the channels used for the supply of lubricating fluid to the drilling tool. When the mixture has hardened, the low pressure at which the lubricating fluid is injected is insufficient to clear the channels leading to the tool; consequently, the monitor must be dismantled for each new drilling cycle in order to remove the residues of hardened cement mixture from it. Independent pumps are also required to provide the supply through the drilling pipe and the jet grouting pipe.

SUMMARY OF THE INVENTION

The object of the present invention is to provide an injection head which can overcome the aforesaid problems. This and other objects and advantages, which will be made clearer below, are achieved according to the invention by a high-efficiency injection head.

The object of the present invention is to provide an injection head which can overcome the aforesaid problems. This and other objects and advantages, which will be made clearer below, are achieved according to the invention by a high-efficiency injection head as defined in claim 1. Other important features are defined in the dependent claims.

BRIEF DESCRIPTION OF THE DRAWINGS

A preferred, but non-limiting, embodiment of the invention will now be described; reference will be made to the attached drawings, in which:

FIG. 1 is a side elevation of an injection head or monitor according to the invention;

FIG. 2 is a view in cross section taken along the line II-II of FIG. 1;

FIG. 3 is a view from above of the monitor of FIG. 1;

FIG. 4 is a view in longitudinal section taken along the line IV-IV in FIG. 3; and FIG. 5 is a view in longitudinal section taken along the line V-V in FIG. 3.

DETAILED DESCRIPTION

With reference to the drawings, an injection head or monitor having an elongate cylindrical external shape, indicated as a whole by 10, is used to feed a pressurized jet of a consolidating fluid mixture, usually a cement mixture, through one or more lateral nozzles 11 to disaggregate and consolidate the surrounding soil. The upper end of the monitor 10 can be connected to a set of tubular rods (not shown) in order to move the monitor vertically and to rotate it. The equipment and methods for jet grouting are well known in the field of geotechnical engineering, and therefore they will not be described or illustrated in this document.

At the top of the monitor there is an inlet pipe 12 for conveying into the monitor both the pressurized consolidating mixture to be supplied to the lateral injection nozzles and the drilling liquid for lubricating the drilling tool or bit (not shown) to be mounted on the lower end of the monitor.

One or more lateral nozzles 11, two of which are shown in the illustrated example, are located in the proximity of the lower end of the monitor, and each of these is connected to the inlet pipe 12 by a corresponding secondary pipe 13 of smaller diameter. Curved portions of pipe 14 are provided, these portions having a constant cross section in this example (although they could equally well be tapered towards the outlet at the nozzle), in order to limit the turbulence of the pressurized mixture and thus divert it from the vertical direction to a substantially horizontal or inclined direction of outflow from the cylindrical body of the drilling rods. The number, shape and arrangement of the lateral nozzles 11 can be varied according to requirements; in particular, they can be orientated in radial directions with respect to the central longitudinal axis x, or can form secants (as in the illustrated example) or tangents with respect to the essentially circular shape of the cross section of the monitor.

In order to supply the lubricant liquid to the lower drilling tool, two pipes 15 extending parallel to the longitudinal axis of the monitor are provided in the preferred embodiment shown in the drawing (FIG. 5). A valve 20 or other means or device for blocking the passage, of the ball, plate, gate or resilient diaphragm type for example, is interposed between the inlet pipe 12 and the pipes 15 for the drilling fluid. Each pipe 15 extends from a transverse channel or cavity 16, located immediately downstream of the valve 20, to a lower chamber 17 which is open at the bottom and is in fluid communication with the drilling tool.

The valve 20 comprises a plug 21 which is slidable in a passage 22 connecting the inlet pipe 12 to the drilling fluid pipes 15. The plug 21 is associated with a spring 23 which tends to keep it in the raised open position of the valve, as shown in FIG. 5. The upper surface of the plug 21 faces the inlet pipe 12 from which both the drilling tool lubricating liquid and the pressurized consolidating mixture are supplied.

During the drilling phase, the drilling fluid is injected at a pressure which is generally lower than that of the consolidating injection fluid, by a few tens of bars for example. The spring 23 is selected in such a way that the pressure of the drilling fluid is not sufficient to compress it beyond the configuration considered optimal to form the residual passage 22 required for the supply to the drilling tool. The drilling fluid thus flows through the passage 22 and the channels 16 and 15 and reaches the drilling tool. It should be noted that a small percentage of this fluid also passes through the channels 13, which bypass the valve 20, and thus reaches the lateral nozzles 11. Since these nozzles have a very narrow cross section, the flow rate of the drilling fluid through them is minimal and in any case insufficient to adversely affect the execution of the work.

When the cement mixture is injected, at a pressure of the order of a few hundreds of bars (300-400 bars, for example), and when a predetermined pressure level to which the valve is calibrated is exceeded, the spring 23 is compressed until the plug 21 completely blocks the passage 22. In this position, the flow of pressurized mixture is taken entirely through the pipes 13 towards the lateral nozzles 11, while the flow through the channels leading to the drilling tool is automatically and immediately cut off.

It will be appreciated that, because of the configuration described above, the cement mixture cannot reach the channels used for the supply of the drilling fluid, and consequently the problems described in the introductory part of this description are avoided. Thus the invention makes it unnecessary to provide a dedicated pipe for the drilling fluid, and therefore enables conventional jetting rods to be used. In other words, the invention optimizes the use of a single supply pipe for both fluids (the consolidating mixture and the drilling fluid), both in the monitor and through the set of hollow rods which supports it. This means that, for a given outside diameter of the monitor and the set of rods, the single supply pipe has a greater cross section than in a case in which the set of rods has to include two or more parallel separate pipes for each fluid. Since the pressure losses are proportional to the fourth power of the diameter of the supply pipe, the use of a pipe having a larger cross section causes the power of the jet supplied to the monitor nozzles to be greater than that found in the high-efficiency injection heads described previously. Consequently, the jet grouting process is more efficient, because a consolidated soil column of greater diameter is produced for the same level of power used. Alternatively, or additionally, it is possible to reduce the outside diameter of the set of rods, which will thus become lighter and more maneuverable on site, and will cause fewer problems of instability in the self-powered drilling machine which carries and operates it. Moreover, it is possible to use a single pump, which will serve both to supply the two pipes in the drilling phase and for the subsequent phase of jetting.

It is to be understood that the invention is not limited to the embodiment described and illustrated herein, which is to be considered as an example of embodiment of the monitor; in fact, the invention can be modified in respect of the form and arrangements of parts and details of construction, and in respect of its operation. For example, the monitor could have a single pipe 15 or more than two of these pipes for conveying the mixture from the inlet pipe to the lower outlet pipe.

The invention claimed is:

1. An injection head for injecting pressurized fluid consolidating mixtures into a soil to form consolidated areas of soil, the head comprising:

a single upper inlet pipe for receiving fluid from a set of tubular rods which can be mounted above the head, at least a first pipe having a curved intermediate portion which connects the upper inlet pipe to at least one lateral injection nozzle, at least a second pipe for conveying a fluid from the inlet pipe to a lower outlet pipe which is connectable to a drilling tool, valve means responsive to pressure of the fluid injected into the head to cut off the flow of the fluid towards the lower outlet pipe, the valve means comprising a plug facing the inlet pipe;

wherein the at least a second pipe extends from a passage which is closable by the plug to the lower outlet pipe; and wherein the valve means are located in a position downstream of the upper inlet pipe and above, or upstream of, the at least one lateral nozzle and the at least a second pipe, wherein when the plug completely blocks the passage, a flow of pressurized fluid consolidating mixtures injected in the inlet pipe is taken entirely through the at least first pipe towards the at least one lateral nozzle, while flow of pressurized cement mixture injected in the inlet pipe cannot reach the at least a second pipe;

wherein the valve means comprises return means for bringing the plug back to an open condition when the injection pressure is below a predetermined level.

2. The injection head according to claim 1, wherein the plug is adapted for completely blocking the passage to the at least a second pipe.

3. The injection head according to claim 1, wherein the return means comprise at least one spring.

4. An injection head for injecting pressurized fluid consolidating mixtures into a soil to form consolidated areas of soil, the head comprising:

a single upper inlet pipe for receiving fluid from a set of tubular rods which can be mounted above the head, at least a first pipe having a curved intermediate portion which connects the upper inlet pipe to at least one lateral injection nozzle, at least two parallel second pipes which extend from a transverse cavity, for conveying a fluid from the inlet pipe to a lower outlet pipe which is connectable to a drilling tool, valve means responsive to pressure of the fluid injected into the head to cut off the flow of the fluid towards the lower outlet pipe, the valve means comprising a plug facing the inlet pipe;

wherein the at least two parallel second pipes extend from a passage and are located immediately downstream of the passage and communicating with the passage to the lower outlet pipe, the passage being closable by the plug; and wherein the valve means are located in a position downstream of the upper inlet pipe and above, or upstream of, the at least one lateral nozzle and the at least two parallel second pipes, wherein when the plug completely blocks the passage, a flow of pressurized fluid consolidating mixtures injected in the inlet pipe is taken entirely through the at least first pipe towards the at least one lateral nozzle, while flow of pressurized cement mixture injected in the inlet pipe cannot reach the at least two parallel second pipes.

* * * * *